US008774439B2

(12) United States Patent
Andersen

(10) Patent No.: US 8,774,439 B2
(45) Date of Patent: Jul. 8, 2014

(54) COMMUNICATION HEADSET WITH A CIRCUMFERENTIAL MICROPHONE SLOT

(75) Inventor: Michael Hoby Andersen, Copenhagen (DK)

(73) Assignee: GN Netcom A/S (DK)

( * ) Notice: Subject to any disclaimer, the term of this patent is extended or adjusted under 35 U.S.C. 154(b) by 385 days.

(21) Appl. No.: 12/957,705

(22) Filed: Dec. 1, 2010

(65) Prior Publication Data

US 2011/0129107 A1 Jun. 2, 2011

(30) Foreign Application Priority Data

Dec. 2, 2009 (EP) ..... 09388017.7

(51) Int. Cl.
*H04R 25/00* (2006.01)

(52) U.S. Cl.
USPC ..... 381/359; 381/360; 381/330; 381/324

(58) Field of Classification Search
USPC ..... 381/381, 330, 313, 322, 328, 374, 361, 381/359, 355, 357, 360
See application file for complete search history.

(56) References Cited

U.S. PATENT DOCUMENTS

| | | | | |
|---|---|---|---|---|
| 3,154,171 | A | 10/1964 | Knutson et al. | |
| 3,976,848 | A | 8/1976 | Estes | |
| 4,073,366 | A | 2/1978 | Estes | |
| 5,442,713 | A | 8/1995 | Patel et al. | |
| 6,091,830 | A | 7/2000 | Toki | |
| 7,961,869 | B1 * | 6/2011 | Zhang et al. | 379/420.04 |
| 2006/0034476 | A1 | 2/2006 | Glezerman | |
| 2007/0003095 | A1 | 1/2007 | Slamka et al. | |
| 2007/0030991 | A1 * | 2/2007 | Frederiksen | 381/330 |
| 2007/0110270 | A1 * | 5/2007 | Tipsmark et al. | 381/374 |
| 2008/0118096 | A1 * | 5/2008 | De Pooter et al. | 381/359 |

FOREIGN PATENT DOCUMENTS

| | | |
|---|---|---|
| DE | 19714422 | 8/1998 |

OTHER PUBLICATIONS

European Search Report for EP 09388017.

* cited by examiner

*Primary Examiner* — Davetta W Goins
*Assistant Examiner* — Phylesha Dabney
(74) *Attorney, Agent, or Firm* — Altera Law Group, LLC

(57) ABSTRACT

A communication headset (1, 15, 25, 35) comprising a housing (2) and a peripheral slot (5) extending along the periphery (30) of the housing (2) in an intersecting plane (6) that intersects the housing (2). A space (7) extends in the intersecting plane (6) and communicates with the slot (5). A porous material (11) is arranged in the space (7), and a first microphone transducer (8) is arranged in the housing (2). The first microphone transducer (8) comprises a microphone opening (9), which is connected to the space (7). The peripheral slot (5) extends along the main part of the periphery (30) of the housing (2).

16 Claims, 5 Drawing Sheets

COMMUNICATION HEADSET WITH A CIRCUMFERENTIAL MICROPHONE SLOT

TECHNICAL FIELD

This disclosure relates to a wearable headset designed to reduce the effects of wind noise and other sources of noise.

BACKGROUND

The term "communication headset" should be interpreted broad as device to be mounted on the or at the head of a user, and which allows hands free communication via the microphone, which captures the user's voice. In many cases, the headset also comprises an earphone to be placed at the ear of the user, so that the user can hear the voice of the other person.

There exist many different types of communications headsets. A communication headset typically comprises at least one earphone and a wearing device for attaching the earphone to the head of the user, such that sound from the earphone speaker enters the ear canal. The earphones can be secured to a user's head by different wearing devices. As examples, these can comprise a headband, a neckband, an "earring" surrounding the outer ear, an earbud, an ear gel, an ear mould or an ear hook. Often, when ear buds, ear gels and ear moulds are used as wearing devices, the headset is simply attached to the user by inserting the wearing device into the ear of user, where it is held in place by the inner sides of the external ear or the ear canal. However, it is possible to combine earbuds, ear gels and ear moulds with other wearing devices such as ear hooks.

The headset can be corded (wired) or wireless (cordless). A corded headset is by means of a wire (cord) connected to e.g. a telephone. A wireless headset comprises a transceiver by means of which it by radio waves, typically according to the Bluetooth or DECT protocol communicates with a telephone or a headset base.

When headsets are used outdoor or in cars with open windows, the sound quality is often hampered by wind noise. Therefore, different approaches have been used to reduce the wind noise. The most used precaution is to cover the microphone behind a windscreen, which can comprise open celled foam, fabric or the like. However, as communication headsets are often compact, there is only a limited space available to accommodate traditional windscreens without destroying the overall design of the headset.

A communication headset according to the preamble is known from US 2006/0034476 in the form of a wireless headset for use with cellular phones. The problem of this headset is, that wind only can flow in essentially one direction without building up pressure in the cavity with the microphone.

SUMMARY

The disclosure relates to a communication headset comprising a housing, a peripheral slot extending along the periphery of the housing in an intersecting plane that intersects the housing, a space extending in the intersecting plane, a porous material being arranged in the space, a first microphone transducer arranged in the housing, the first microphone transducer comprising a microphone opening, which is connected to the space.

More particularly, the disclosure relates to a microphone arrangement in communication headsets, where the microphone is arranged in a way to reduce wind noise.

There are many objects of the disclosure and claimed invention. A few are as follows: One object of the disclosure is to provide a communication headset with good performance in windy environments mad that can be implemented in an efficient and simple way. Another object of the disclosure is obtained by a communication device according to the preamble, which is characterized in that the peripheral slot extends along the main part of the periphery of the housing. With such a solution, the wind can enter the slot at one position and leave the slot at the opposite position without creating wind noise. The solution can be very compact and still efficient.

According to preferred embodiments, the peripheral slot extends along at least 180, preferably at least 270, more preferably at least 315 degrees and most preferably 360 degrees of the periphery, when seen from the microphone transducer. In these cases, the risk of the wind building up pressures due to "blind holes" can be reduced efficiently.

According to an embodiment, the microphone opening points in a direction, which is perpendicular to the intersecting plane. With such a construction, the risk of wind noise due to the fact, the microphone opening itself may create a small "blind hole", is reduced.

According to a preferred embodiment, the housing comprises a first housing part and a second housing part, which are divided by the peripheral slot and together defining an outer housing surface.

According to a particularly preferred embodiment, a plate shaped part of porous material is provided between the first housing part and the second housing part. This plate shaped part can consist of rigid porous material. Such rigid material can be "self-supporting, spanning the first and second housing parts to form a substantially smooth surface (from the point of view of airflow) whereby additional supporting parts between the first housing part and the second housing part can be omitted. The peripheral slot h is bridged by a porous material provided between the first and second housing parts, the porous materials extending up to the outer surfaces of the housing parts at the slot so to define a contiguous smooth outer housing surface across the slot of even height with the surfaces of said first and second parts.

According to an alternative embodiment, the plate shaped part consists of elastic porous material, such that the first housing part and the second housing part upon a compressing force can be moved towards each other and an electronic switching function is associated with this movement. In this case, the windscreen and mechanical switching is combined in an elegant way.

The slot can have different thicknesses, but preferably, the slot is maximum 5, 4, 3, 2 or 1 mm thick.

Preferably, the porous material fills out the slot and provides a continuous surface with the housing surface. This provides less turbulence at the border between the slot and the outer surface of the housing. Furthermore, it provides a more smooth design which acoustically and aerodynamically minimize turbulence of all pass thereby, but is largely transmissive to sound with minimal attenuation.

According to an embodiment, the housing comprises a boom, wherein the peripheral slot is provided at the end of a boom. In this case, a better sound quality can be obtained, as the microphone can be placed closer to the user's mouth during use.

According to an embodiment, the housing is adapted to be arranged at the ear of a user and comprising a speaker.

The headset housing may comprise transceiver electronics for wireless communication with a communications headset, such as a cell phone.

In a particularly preferred embodiment, the plane essentially extends parallel to the side of the head of a user, when the headset is worn by the user.

According to yet another embodiment, the communication headset is embodied as a hearing aid.

According to the disclosure, the slot may extend along the outermost periphery, when seen in projection. Hereby, a relatively long distance between the microphone transducer and the windy surroundings can be obtained despite housing the housing being small.

The above summary is for the convenience of the reader. It does not define the scope of the invention but is present to assist the reader in reviewing the entire disclosure. The claims define the scope of the invention.

BRIEF DESCRIPTION OF THE DRAWINGS

The detailed description (disclosure) is explained in detail below with reference to the drawing illustrating different embodiments of the disclosure and in which.

MODES FOR CARRYING OUT THE DISCLOSURE

In the following, the same reference signs are, in several instances, used for the same or corresponding parts in the different embodiments. All figures are schematically showing the most important features only. Some features are left out in order to clarify the disclosure.

Figure 1:
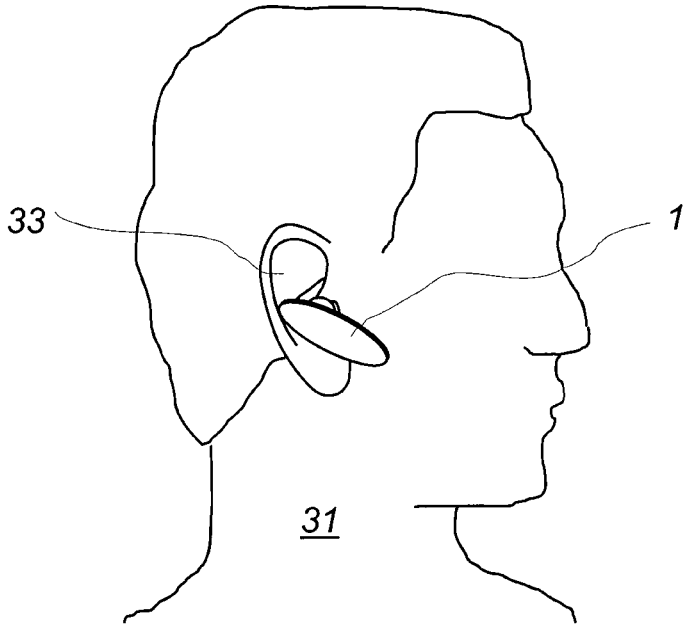
FIG. 1 is a perspective view of a user wearing a communication headset according to a first embodiment.

FIG. 1 discloses a user 31 wearing a headset 1 at his right ear 33. The headset 1 is a wireless headset communicating with a peripheral device such as a mobile phone according to the Bluetooth™ standard.

Figure 2:
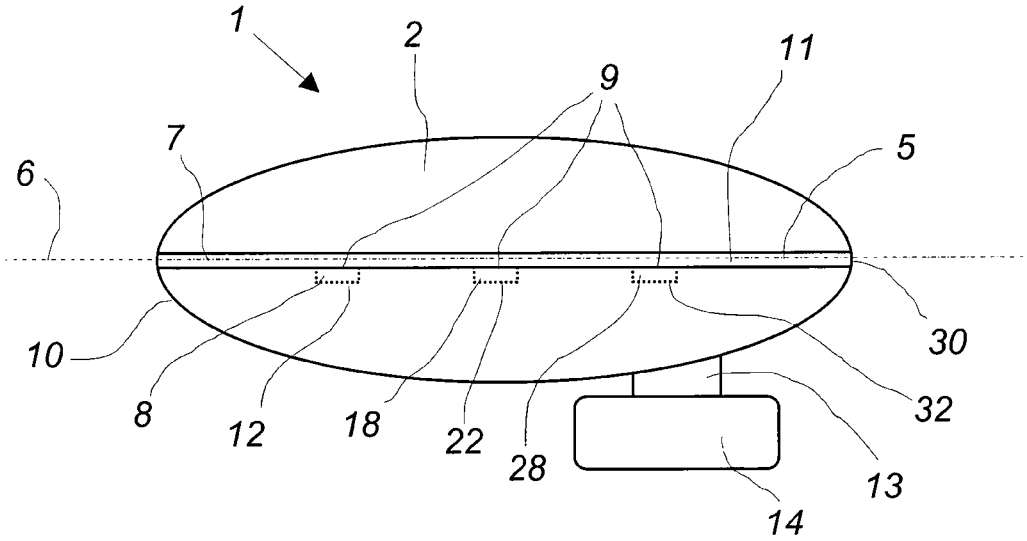
FIG. 2 is a side view of the headset according to the first embodiment.
Figure 3:
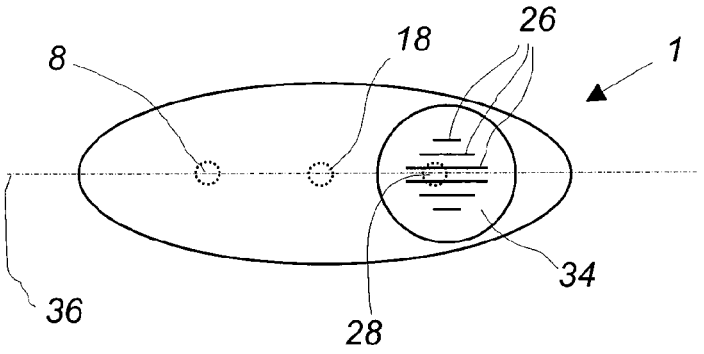
FIG. 3 is a bottom view of the headset according to the first embodiment.

FIG. 2 discloses a side view of the headset 1, and FIG. 3 discloses a bottom view of the same. The headset 1 comprises a housing 2, a protruding speaker tower 13 and an ear bud 14 at the free end of the speaker tower 13. The headset 1 is simply attached to the head of the user 31 by inserting the ear bud 14 into the outer ear 33, where it is held in place by the internal sides of the outer ear 33. However, other attachment means, such as an ear hook, a headband, a neckband, could be used as well. A speaker transducer (not shown) is arranged in the speaker tower 13, but could alternatively be arranged in the housing 2. Audio from the speaker transducer is conducted to the user's ear through openings 26 in the front face 34 of earbud 14. In a plane 6, that intersects the housing 2, a slot 5 divides the housing 2 into a first housing part 3 and a second housing part 4. The slot 5 extends along the complete periphery 30 of the housing 2 and communicates with an internal space 7 with the same thickness as the slot 5. A plate-shaped part 11 of rigid porous material fills out the slot 5 and the space 7, thereby extending in the complete cross-section of the housing 2. The plate-shaped part 11 is rigid and strong enough to be the only structural part interconnecting the first housing part 3 and the second housing part 4. Other, non-structural parts, such as wires, can connect the first housing part 3 to the second housing part 4. In the shown embodiment, the plate-shaped part 11 has a thickness of about 2 millimeters. Three microphone transducers 8, 18, 28 are arranged in respective recesses 12, 22, 32 in the first housing part 3. Thus, the first microphone transducer 8 is arranged in the first recess 12, the second microphone transducer 18 in the second recess 22 and the third microphone transducer 28 is arranged in the third recess 32. A microphone opening 9 of each microphone transducer 8, 18, 28 faces the plate-shaped part 11, and the microphone transducers 8, 18, 28 are all arranged on a centre line 36. There can be several reasons for using more than one microphone, e.g. in order to obtain directionality or reduce background noise. It is out of the scope of this application to go into more details of this, as the disclosure works with only one microphone transducer. The material of the plate-shaped material is e.g. porous plastic, such as high-density polyethylene, e.g. with a pore size of 300-500 micrometers. It is preferably audio porous and wind resistant so that wind pressures are dissipated therein but sound is largely transmissive with little loss. The material should not be airtight but slow down the wind to a low speed at the microphone openings 9 so that wind induced noise is minimized. Likewise, the materials should silently reduce wind speed through the headset by creating a plurality of baffles and passages which by their various sizes and shapes do not create significant noise when impinged by air currents. An open pore foam material exhibits such characteristics. Suitable porous material can be obtained from Porex® Technologies 500 Bohannon Road Fairburn, Ga. 30213 USA.

In the preferred embodiment, the peripheral slot 5 extends along the complete periphery, the wind will not "meet a wall" which causes pressure changes close to microphone transducers 8, 18, 28. The wind speed change occurs distance from the microphone(s). Thus, the wind will pass the microphone transducers 8, 18, 28 at a relatively slow speed without inducing wind noise having been slowed by the multiplicity of cells formed in the porous material. The preferred porous material has a cellular structure of irregularly shaped and irregularly oriented cell/pocket areas. One theory is that wind entering is dispersed into the multiplicity of cells and is slowed, but because the cell structure is irregular, the speed reduction is not uniform and simultaneous across the cells and thus does not create a uniform reinforcing sound waves (wind noise) at the microphone. Another theory on which this works is that the porous material makes it difficult for vortices to be created, as the cell structure, to a great degree, determines that vortices are not created within the cells.

A mere wind baffle, like Gortex® which is wind transmissive, is made of a regular woven patterns. When wind strikes such a surface, it will deflect because it provides a uniform wall to the wind. Without the irregular pockets of the present materials, the wind speed would be decreased, but it will likewise send a pressure wave to the microphone, which would be a muffled wind noise and not solve the problem at hand. This is the case, no matter which direction the wind has through the plate-shaped part 11. During use, the plane 6 of the peripheral slot 5 is essentially parallel to the side of the user's head. This is advantageous with regard to the most frequent occurring wind directions around the headset 1. Wind direction parallel to the plane 6 of the slot 5 induces very little wind noise at the slot 5, as the wind can enter the slot with no change of direction. Wind will pass by the outer surface of the headset much like wind passes over a wing of an airplane with the porous material appearing solid with wind passing parallel to the headset body. Wind coming perpendicular to the slot 5 may already be slowed down by the wearer's head when the head is situated behind the headset when seen in the wind direction. Otherwise, wind will be scattered into the plurality of pockets in the porous material causing a decrease in wind speed but at different point and angles with the porous materials, thus creating wind speed reductions in the various pockets and pores which are generally not in phase with each other, and hence, quieter. By the time the wind/air pressure reaches the microphone(s) is pressure is vastly reduced.

The shape of the headset housing 2 can be characterized as oval or having semi-circular head and tail pieces joined together by an elongated portion. This shape is also advantageous, as it minimizes turbulence-induced noise. As shown in FIG. 2, the outer side of the plate-shaped part 11 is flush with the outer sides/skin of the first housing part 3 and the second housing part 4, whereby no turbulence occur here. The space therebetween is likewise filed with porous material 5.

The housing 2 is approximately 63 millimeters long, 19 millimeters wide and 19 millimeters high. The microphone transducers 8, 18, 28 are approximately 3 millimeters in diameter, and the distance between the centres of the microphone transducers 8, 18, 28 is approximately 16 millimeters. The shortest distance between one of the microphone transducers 8, 28 and the outer side of the housing in the intersecting plane 6 is approximately 6 millimeters.

Figure 4:
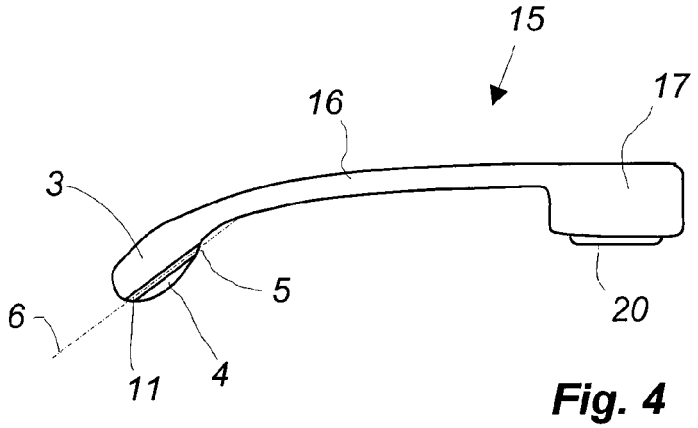
FIG. 4 is a side view of a headset according to a second embodiment.
Figure 5:
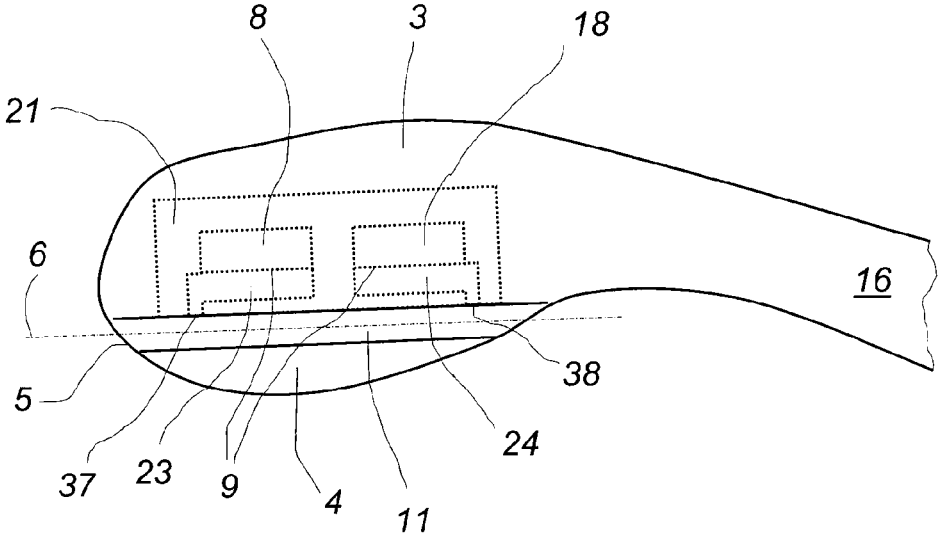
FIG. 5 is an enlarged side view of a part of the second embodiment.

FIGS. 4 and 5 disclose a second embodiment of the disclosure. In this case, the headset 15 is embodied as an earphone part 17 with a protruding microphone arm 16, possibly with pivotal capability. When in use, the earphone part 17 is arranged at the user's ear with a speaker front 20 facing the ear and the microphone arm 16 pointing in the direction of the user's mouth. As shown, the microphone arm 16 has a thickened outer end part comprising two microphone transducers 8, 18. These are arranged in a so-called "microphone boot" 21, which is a rubber part encapsulating the microphone transducer 8, 28. Two sound channels 23, 24 connect the microphone openings 9 with the plate-shaped part 11 connecting the first housing part 3 and the second housing part 4. The sound openings 37, 38 of the sound channels 23, 24 are spaced further distance from each other than the microphone openings 9. In this way, a good sound directionality due to a relatively long distance between the sound channel openings 37, 38 is obtained, although the microphone transducers 8, 18 are placed relatively close to each other in order to obtain a compact construction. When in use, the plate-shaped 11 part is essentially parallel with the user's cheek.

The second housing part 4 is approximately 20 millimeters long, 8 millimeters wide and 2 millimeter thick. The microphone transducers 8, 18 are approximately 3 millimeters in diameter. The distance between the centres of the sound channel openings is approximately 12 millimeters. The shortest distance between one of the sound channel openings 36, 37 and the outer side of the housing in the intersecting plane 6 is approximately 2 millimeters.

Figure 6:
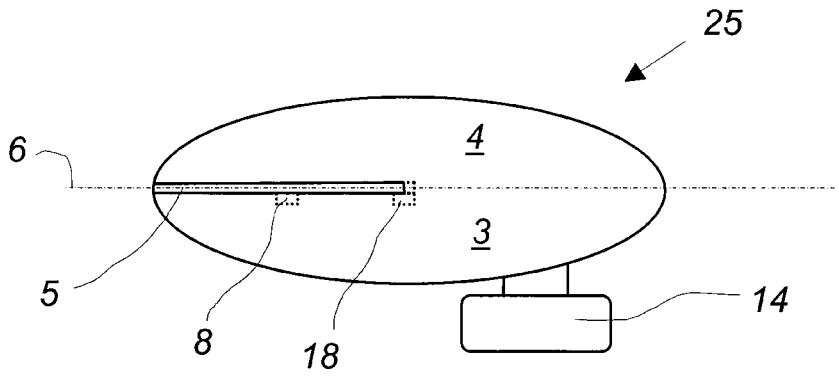
FIG. 6 is a side view of a headset according to a third embodiment.
Figure 7:
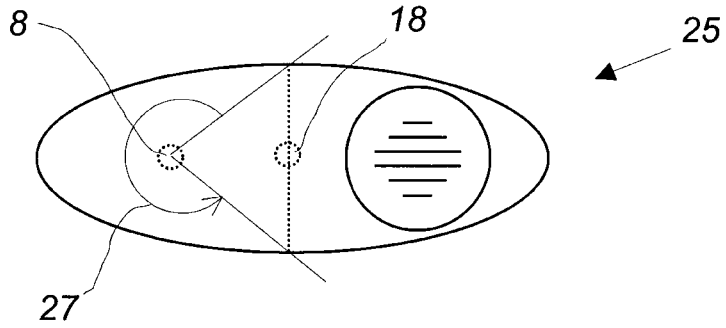
FIGS. 7 and 8 are bottom views of the third embodiment.
Figure 8:
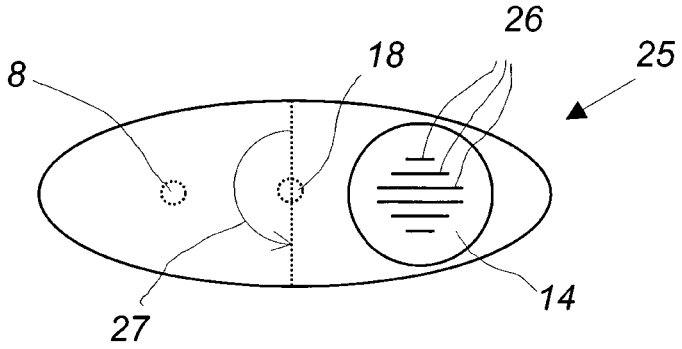

FIGS. 6, 7 and 8 disclose a third embodiment of a headset 25 according to the disclosure. This headset 25 has a housing 2 with the same shape as that of the first embodiment, but differs by the peripheral slot extending along half of the headset's 25 circumference only and having two microphone transducers 8, 18. The arrow 27 in FIGS. 7 and 8 indicate the directions the wind can flow pass the microphone transducers 8, 18 without encountering essential "blind hole" effect, which causes building up pressure, which again causes undesirable noise. Thus, in FIG. 7 it is disclosed that the wind can flow in any direction within an angle 27 of approximately 270 degrees without causing noise at the first microphone transducer 8. In FIG. 8, it is disclosed that the wind can flow in any direction within an angle 27 of approximately 180 degrees without causing noise at the second microphone transducer 18. Modern headsets with two microphones normally comprise some kind of intelligent electronics controlling the mixed output from the two microphones. Thus, if there were a strong wind in a direction outside the 180 degrees angle 27 shown in FIG. 8 but within the 270 degrees angle of FIG. 7, the electronics would attenuate the signal from the second microphone 18, as this would capture wind-induced noise. If only one microphone transducer were used in the embodiment shown in FIGS. 6-8, the first microphone transducer 8 would normally be preferred.

Figure 9:
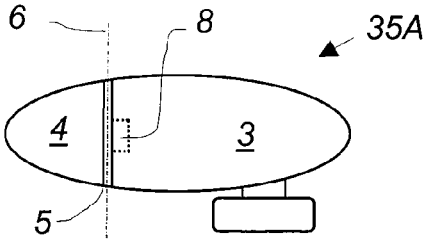
FIG. 9 is a side view of a headset according to a fourth embodiment.
Figure 10:
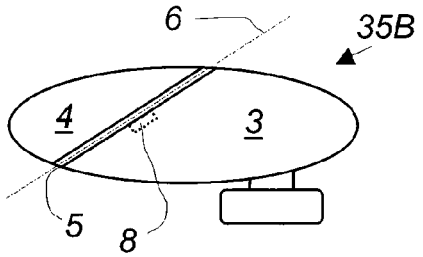
FIG. 10 is a side view of a headset according to a fifth embodiment.
Figure 11:
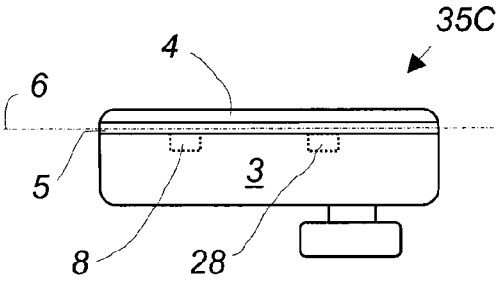
FIG. 11 is a side view of a headset according to a sixth embodiment.
Figure 12:
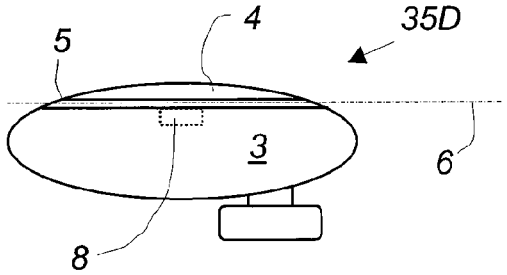
FIG. 12 is a side view of a headset according to a seventh embodiment.
Figure 13:
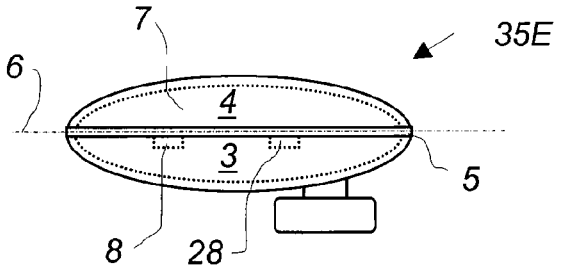
FIG. 13 is a side view of a headset according to an eighth embodiment.

FIGS. 9-13 show alternative embodiments of a headset 35 according to the disclosure. In FIG. 9, the intersecting plane 6 is perpendicular the longitudinal direction of the headset housing. In FIG. 10, the intersecting plane 6 is oblique in relation to the longitudinal direction of the headset housing. In FIG. 11, the intersecting plane 6 is parallel to the longitudinal direction of the headset housing and positioned relatively close to a plane outer side of a relatively thin, massive second housing part 4. In FIG. 12, the intersecting plane 6 is parallel to the longitudinal direction of the headset housing and positioned relatively close to a rounded outer side of a massive second housing part 4. The headset 35E disclosed in FIG. 13 differs from the other embodiments by having a relatively large space 7 communicating with the peripheral slot 5. Thus, the space 7 corresponds to the inner of the housing 2 and is filled with soft foam in the areas, which are not taken up by the headset electronics.

The disclosure is disclosed by means of different embodiments. Features from these can be combined or amended in different ways.

High-density polyethylene as porous plastic is proposed as porous material for reducing the wind speed. However, other materials with suitable varying pore sizes and acoustic resistances can be used. Also soft materials can be used. In this case, further structural parts connecting the first housing part 3 and the second housing part 4 can be provided in order to relieve strain from the soft foam, at least in some directions. Soft foam could be utilized for providing a small relative movement with switching functionality between the first housing part 3 and the second housing part 4. For example, a switching function could be activated, when the first housing part 3 and the second housing part 4 is pressed together. This could be utilized for switching the headset on and off or answering and ending phone calls.

It is not absolutely necessary with porous material in the peripheral slot 5, as the depth of this in many cases is small compared with the dimensions of the space 7 inside the slot 5. However, if the slot 5 is filled with porous material 11 such that this material 11 is flush with the outer side of the first and second housing parts 3, 4, the occurrence of turbulence here is minimized or eliminated. The peripheral slot (5) is therefore bridged by a porous material provided between the first and second housing parts, the porous materials extending up to the outer surfaces of the housing parts at the slot so to define a contiguous smooth outer housing surface across the slot of even height/flush with the surfaces of said first and second parts.

In most cases, a rounded housing 2 as shown in FIGS. 2, 36-10 and 12-13 is advantageous, as this reduces the risk of turbulence at the peripheral slot.

In the embodiments shown in FIGS. 2, 6-9, 9, 10 and 13 both the first and second housing parts 3,4 may enclose headset electronics, whereas there is no room for this in the second housing part 4 of the embodiments shown in FIGS. 11 and 12. However, it may not be necessary to make use of the second housing part 4 in e.g. the embodiments shown in FIGS. 9 and 10, if the first housing part 3 is big enough for housing all the necessary electronics.

Figure 14:
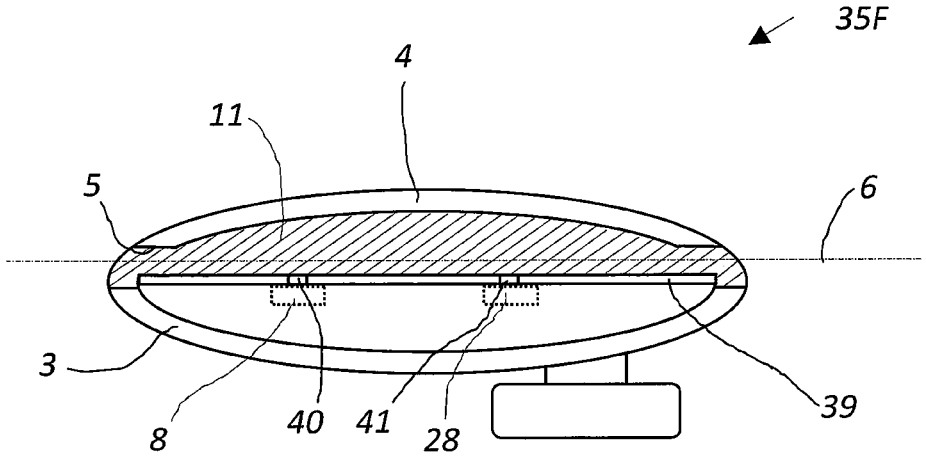
FIG. 14 is a side view of a headset according to a ninth embodiment.

FIG. 14 shows an embodiment which differs from prior embodiments in that the microphones are supported by a pcb (printed circuit board) or flexprint 39 and the pcb has apertures 30, 41 for the microphones. The pcb is fitted onto the porous foam material (shaded area) which can fill the roughly half of the interior space of the headset and extends to the slot 5 to created a smooth almost seamless exterior. It therefore also provides a microphone support system which tends to mechanically isolate the microphones from shock to the housing.

All over the description, a slot is described as a continuous narrow opening. However, a long series of smaller openings or a row of shorter slots, a grill pattern or any combination thereof may be contemplated and should be regarded as being encompassed by the term slot.

The disclosure also encompasses a method of reducing wind noise pickup in a headset built according to the above disclosure. The method also includes the steps of forming two mating portions, including halves of a shell which contains at least one microphone, proving a circumferential gap between said halves when said brought together, providing a audio-porous material which fills the gap so that the external surface of the two halves and material form an acoustically smooth surface, locating the microphone within the halves adjacent the material so that sound passing therethrough will reach the microphone but wind noise will be largely dissipated within the material. The gap or slot need not be completely circumferentially placed but may also form slots on opposite faces of the halves.

REFERENCE SIGNS

1 headset
2 housing
3 first housing part
4 second housing part
5 peripheral slot
6 plane
7 space
8 microphone transducer
9 microphone opening
10 outer housing surface
11 plate shaped part of porous material
12 microphone recess
13 speaker tower
14 earbud
15 headset
16 microphone arm
17 earphone part
18 microphone transducer
19 microphone opening
20 speaker front
21 microphone boot
22 microphone recess
23 sound channel
24 sound channel
25 headset
26 openings in earbud
27 "viewing angle" of microphone transducer
28 microphone transducer
29 microphone opening
30 periphery
31 user
32 microphone recess
33 outer ear of user
34 front face of ear bud
35 headset
36 centre line
37 opening of first sound channel
38 opening of second sound channel
39 flexprint or printed circuit board PCB
40, 41 sound holes in PCB for microphones The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A communication headset comprising:

a housing, a peripheral slot extending along at least 180 degrees of the periphery of the housing in an intersecting plane that intersects the housing, a space extending in the intersecting plane and communicating with the slot, a porous material being arranged in the space, a first microphone transducer arranged in the housing, the first microphone transducer comprising a microphone opening, which is connected to the space, wherein the peripheral slot extends along the main part of the periphery of the housing and wherein the housing comprises a first housing part and a second housing part, which are divided by the peripheral slot which is bridged by a plate shaped part of said porous material provided between the first and second housing parts and extending around at least a portion of the periphery in said slot, the porous materials extending up to the outer surfaces of the housing parts at the slot so to define a contiguous smooth outer housing surface across the slot flush with the surfaces of said first and second parts and wherein said porous material together with said housing parts creates a substantial aerodynamically smooth surface and said material fills out the slot and provides a continuous surface with the housing surface, and wherein a plate shaped part of acoustically said porous material said material being rigid and largely wind impervious and which is self supporting to be able to support the interconnection between the housing parts is provided between the first housing part and the second housing part, and wherein said microphone is located immediately adjacent said plate shaped part but generally perpendicular to the plane of the said plate shaped part, thereby providing a substantially acoustically barrier free path audio path, aside from the porous material, between said slot and said microphone.

2. A communication headset according to claim 1, wherein the peripheral slot extends along at least 270, more preferably at least 315 and most preferably 360 degrees of the periphery, when seen from a microphone transducer.

3. A communication headset according to claim 1, wherein the porous material is planar on one surface and hemispherical on the other, thereby filling a portion of the housing.

4. A communication headset according to claim 1, wherein said plate shaped part is substantially planar and has a longitudinal peripheral edge adjacent said slot and wherein said microphone is located immediately adjacent said plate shaped part at said edge and adjacent a housing part.

5. A communication headset according to claim 1, wherein said plate shaped part has a longitudinal peripheral edge adjacent said slot and wherein said microphone is located adjacent said slot and adjacent a housing part.

6. A communication headset according to claim 5, wherein plate shaped part consists of a substantially rigid porous material.

7. A communication headset according to claim 1, wherein the slot is maximum 5, 4, 3, 2 or 1 mm thick.

8. A communication headset according to claim 1, wherein the porous material provides a seamless connection between adjacent housing surfaces.

9. A communication headset according to claim 1, wherein the housing comprises a boom, and wherein the peripheral slot is provided at the end of the boom.

10. A communication headset according to claim 1, wherein the housing is adapted to be arranged at the ear of a user and comprising a speaker.

11. A communication headset according to claim 10, wherein the headset housing comprises transceiver electronics for wireless communication with a communications headset, such as a cell phone.

12. A communication headset according to any of the claim 10, wherein the plane essentially extends parallel to the side of the head (x) of a user, when the headset is worn by the user.

13. A communication headset according to any of the claim 10, wherein the communication headset is embodied as a hearing aid.

14. A communication headset, according to claim 1, wherein the slot extends along the outermost periphery, when seen in projection.

15. A method of constructing a headset to reduce the effects of wind noise comprising the steps of forming an outer shell of the headset of two mating portions of a shell which contains at least one microphone, providing at least a partial circumferential gap which extends around the circumference, between said portions when said brought together, providing a compressible audio-porous material which fills the gap flush with the outer surfaces of the shell portions, so that the external surface of the two portions and material form an acoustically and/or aerodynamically smooth surface, locating the microphone within the portions adjacent the material so that sound passing therethrough will reach the microphone but wind noise will be largely dissipated within the material and so that the outer shell may be user compressed against said porous material to operate a feature of the headset.

16. The headset of claim 1, wherein the slot creates a barrier free passageway to said microphone, aside from said porous material, so that sounds are not deflected or distorted by hard barriers.

* * * * *